United States Patent [19]

Goulter

[11] Patent Number: 4,864,941

[45] Date of Patent: Sep. 12, 1989

[54] FOLDING WORKBENCH WITH SIDE PLATFORM

[76] Inventor: Victor H. Goulter, 485 Molimo Dr., San Francisco, Calif. 94127

[21] Appl. No.: 100,580

[22] Filed: Sep. 24, 1987

[51] Int. Cl.[4] ..... A47B 3/00

[52] U.S. Cl. ..... 108/132; 269/901; 269/208

[58] Field of Search ..... 108/131–133, 108/127; 298/188.6, 463; 269/901, 139, 289 R, 208

[56] References Cited

U.S. PATENT DOCUMENTS 1,959,725 5/1934 Lindsay ..... 108/132

2,470,869 5/1949 Schmidt ..... 108/132

*Primary Examiner*—Robert C. Watson

*Attorney, Agent, or Firm*—David Pressman

[57] ABSTRACT

A folding workbench (20) comprises a top portion comprised of two parallel spaced boards (12 and 14) with an adjustable work holder (17) mountable along each board. One corner of the top has a vernier vise (16) attached thereto; the vise can grip work itself and can cooperate with the adjustable work holder for wide work or a fixed stop 80 at an adjacent corner for gripping very long work. The vise is mounted on a swivel plate (101) which has a quadrant shape and is surrounded by a groove (100) cut in the top of the bench to give unrestricted pathway to the vise's locking plate. The top is supported by two pair of legs (38 and 40), one pair at each end of the top. Each pair is hingedly attached (45) to the underside of the top, with one pair being hingedly attached at a lower position (spaced from the top) by the use of a spacer block (32) so that the legs can be folded against the top in a compact arrangement. Each pair of legs is braced by a strut (62) which has its lower end hingedly mounted to a midpoint (60) of its pair of legs and extends to the center of the underside of the top. A side platform (106) can be attached to either pair of legs rapidly and adjustably by means of a pair of brackets (108) under the platform.

4 Claims, 8 Drawing Sheets

FOLDING WORKBENCH WITH SIDE PLATFORM

BACKGROUND—FIELD OF INVENTION

The present invention realates to workbenches, in particular to a folding type bench fitted with a vise to facilitate multiple-clamping arrangements, including use of an adjustable side platform.

BACKGROUND—RELATED PATENTS

This invention can use the adjustable vernier vise shown in my U.S. Pat. Nos. 4,449,704 (1984) and 4,572,494 (1986) and the workpiece holder in my U.S. Pat. No. 4,475,727 (1984).

BACKGROUND—DESCRIPTION OF PRIOR ART

In the past, folding workbenches have proved unreliable as a sound surface on which to do professional, heavy or varied types of woodwork and or metal work. They lacked rigidity and thus move about while work was being performed on workpieces clamped thereon. They have also not provided the ideal clamping positions of the workpieces for the user, resulting in backache and fatigue.

One prior workbench commonly sold under the trademark Workmate employs a double tightening screw arrangement which clamps the workpiece near the center of the bench between two elongated boards, requiring the user to lean over when performing work thereon. Also its work surface is not substantial or sufficiently supported to do hammering or chiseling; i.e., its lightness of construction, together with its intricate folding mechanism, does not provide enough support for normal workshop or basement workshop practices. Therefore, the user finds it necessary to purchase or build a more rigid fixed workbench to do heavier work. The folding bench thus is more of a tool than a workbench.

In addition to its lack of sturdiness, the Workmate bench has no provision to hold certain workpieces, such as a chair leg, or a pedestal of a table lamp or small table, by their ends. Also, while wooden or plastic pegs are supplied to hold wider workpieces, such pegs are not sufficiently strong to hold such workpieces against businesslike efforts, as in sawing, mortising, chiseling, drilling, etc. Further, its short length is not adequate to hold firmly long pieces of lumber, resulting in users having to invest in sawhorses to deal with long planks. While the Workmate bench can be used as a sawhorse by folding its leg sections inward so as to lower its height to a more suitable level, this is inconvenient, clumsy, and time consuming.

Very often, in many woodworking projects, it is necessary to deal with metal parts, such as bolts, hinges, screws, knobs and handles, pivot systems, spindles, metal reinforcements, strip covers, etc. Provision for holding, cutting shaping these metal parts is not adequately provided for in the Workmate bench. Butcherblock laminates are extremely expensive and often are needed in wide sections, such as to make a three foot round or rectangular or square coffee table. I have found it impossible to make more than a very small sections with a Workmate bench. in wide sections, such as to make a three feet diameter round or rectangular or a square coffee table. I have found it impossible to make any more than very narrow sections with a Workmate bench.

OBJECTS AND ADVANTAGES

Accordingly, I claim the following objects and advantages of my invention: to provide a folding workbench which has ample rigidity for normal workshop use, including hammering, chiseling, mortising, sawing, drilling, planing etc, which can be set up or unfolded quickly and easily, which when folded, can be carried from place to place or through narrow passages, which has support legs which are rigidly held, thereby making the bench a firm surface on which to work, which will not move around under working conditions, which has parts which do not loosen during use, and which has multiple-clamping arrangements, including lengthwise clamping, crosswise clamping, vertical clamping, swivel clamping, angle clamping, endwise clamping, butcher block diagonal clamping, and easy release clamping.

Additional objects are to provide a workbench which can be used for woodwork as well as metalwork, and which the user can stand upright and alongside a workpiece in a manner which will not cause fatigue or backache.

Further objects are to provide a folding workbench on which a side platform can be fitted or removed rigidly, which can be raised or lowered speedily, which there are no moving or attached parts which can become loose, and in which locks automatically in place without clamps, screws, wingnuts, or the like.

Further objects are to provide a workbench with which a wide sections of butcherblock laminates can easily be made, and to provide a workbench which provides clamping for metal workpieces as well as clamping in a mmanner which protects highly polished or easily damaged surfaces or structure, such as the thread of a fine brass screw, a glass door knob, or a length of highly polished hinge. Additional objects are to provide a workbench in which workpieces clamped in the vise can be swivelled to the most convenient position for the user to perform the desired work thereon.

Readers will find further objects and advantages of the invention from a consideration of the ensuing description and the accompanying drawings.

Reference Numerals

| | | | |
|---|---|---|---|
| 10 | folding workbench | 69 | apex |
| 12 | plank | 70 | protruding portion |
| 13 | spacer | 71A and 71B | slots |
| 14 | plank | 72A and 72B | concaves |
| 16 | vernier vise | 73 | threaded bolt |
| 17 | work holder | 74 | locknut |
| 20 | transverse bolt | 75 | metal plate |
| 22 | bench end | 76 | rubber pad |
| 23 | hole | 77 | square tube end |
| 24 | member | 77' | hole |
| 28 | member | 78 | metal insert |
| 29 | side | 80 | stop |
| 30 | lower side | 82 | metal plate |
| 32 | third member | 84 | rubber lining |
| 36 | edge | 85 | slot |
| 38 | metal legs | 87 | protruding bolt |
| 40 | metal legs | 88 | protruding bolt |
| 42 | angle iron member | 89A and | channels |

-continued

| Reference Numerals | |
|---|---|
| | 89B |
| 43 pair of hinges | 90 angle bend |
| 44 angle iron member | 91 angle bend |
| 45 leg hinge | 92 wingnut |
| 46 spring clip | 93 wingnut |
| 47 bolt | 94 bolt |
| 48 screw | 95 bolt |
| 50 slot | 96 hole |
| 52 base member | 97 hole |
| 54 adjusting bolt | 100 semi-circular groove |
| 56 stayrod bar | 101 swivel plate |
| 57 ends | 103 swivel pin hole |
| 58 wingnut | 104 pressure plate |
| 59 pressure face | 106 side platform |
| 60 sleeve | 107 flat surface |
| 61 weld spots | 108 bracket |
| 62 stayrod | 109 right angle bend |
| 63 threaded end piece | 110 lower side |
| 64 bracket | 111 screws or bolts |
| 65 locknut | 112A and 112B rubber pads |
| 66 spring | 113A and 113B hook portions |
| 67 screws | 116 notched portions |
| 68 ends | 115 front |
| | 114 phantom lines |

DRAWING FIGURES

DESCRIPTION—GENERAL

Figure 1:
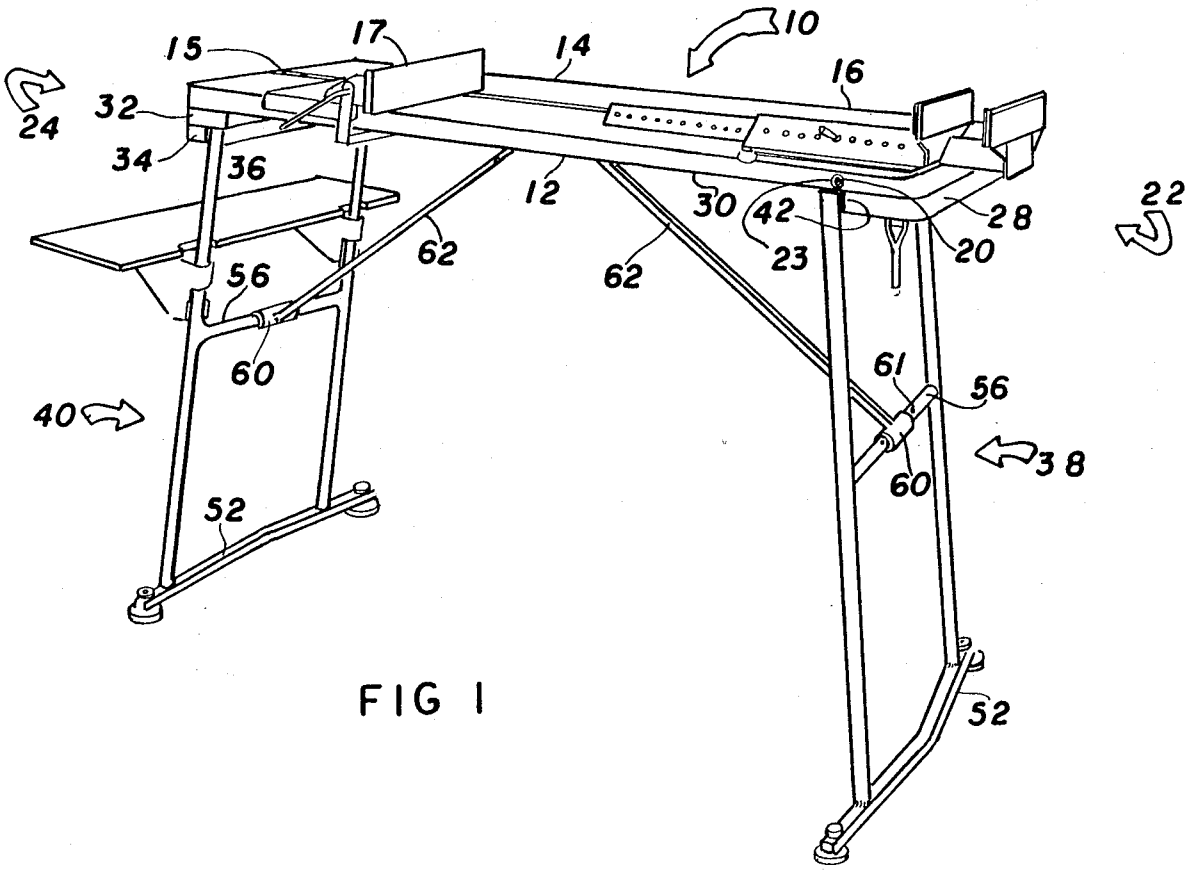
FIG. 1 is a perspective side view of a folding workbench according to the invention.
Figure 6:
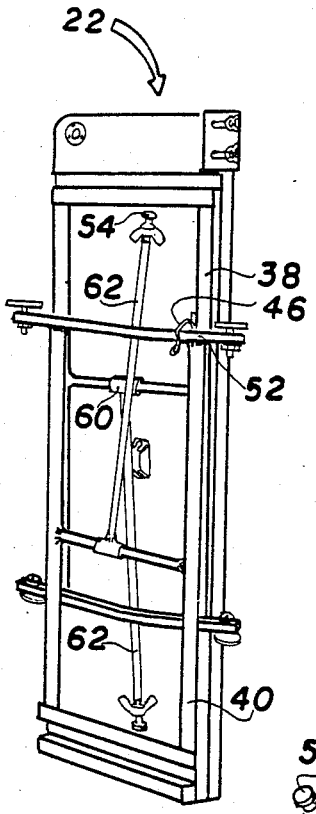
FIG. 6 is a perspective view of a second pair of legs when folded and clamped in place.

FIG. 1 shows a general view of the folding workbench 10 of the present invention in which two planks 12 and 14 are spaced 15 mm ($\frac{5}{8}$ in) apart and rigidly joined by members 28 at end 22 and by members 32 and 34 at end 24. The bench top is supported by pairs of legs 38 and 40 hinged under the bench top. Each pair of legs is rigidly braced by stayrods 62 which are removably locked to the underneath center of the bench top and, which when unlocked will allow the pairs of legs to fold inward to form a compact unit (FIG. 6). My vernier vise 16 is pivotably attached to one corner of the bench top and can be swivelled 360 degrees and cooperates with work holder 17 or fixed stop 80. An adjustable side platform 106 can be removably attached to either pairs of legs. These will be discussed in separate sections below.

TOP OF BENCH

Figure 2A:
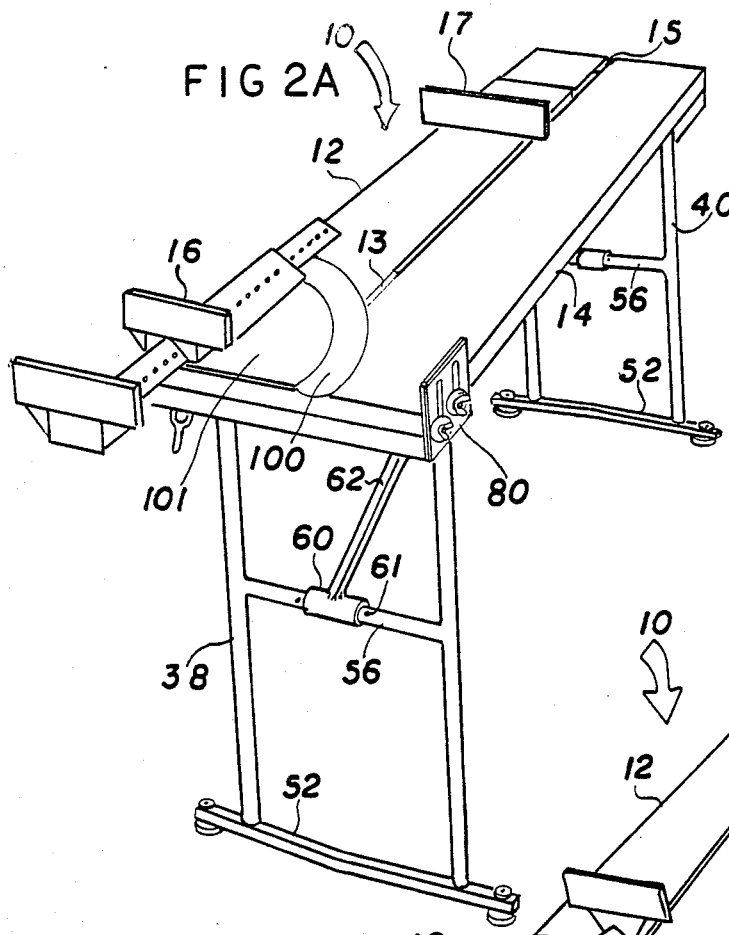
FIG. 2A is a perspective end view of the workbench together with my vernier vise and workpiece holder.
Figure 2B:
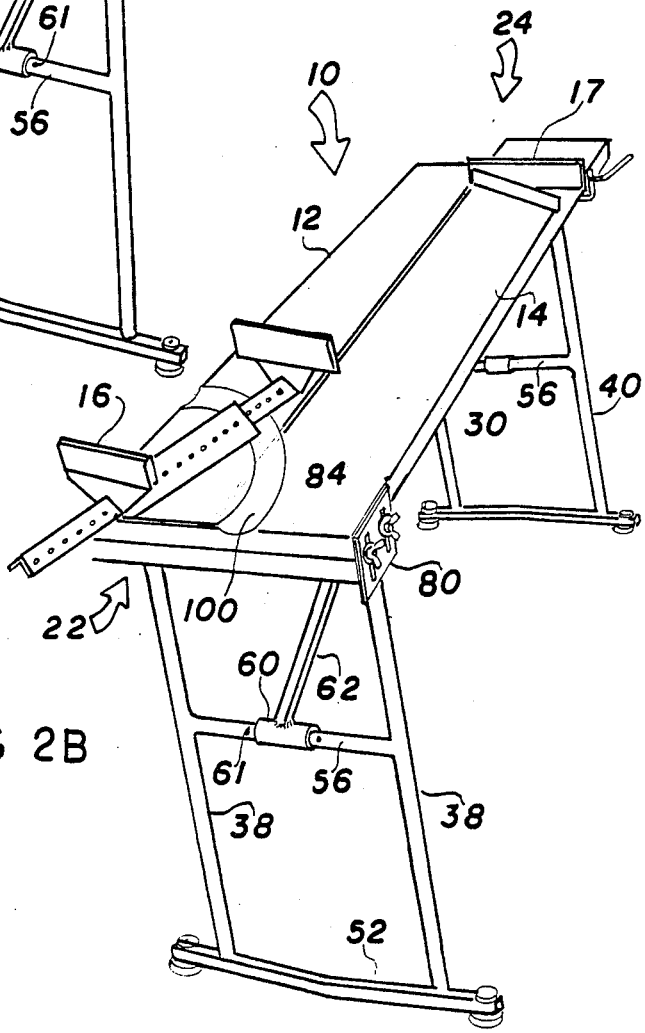
FIG. 2B is a perspective view of the workbench showing alternative positions and angles of the vernier vise and workholder.

FIGS. 2A and 2B show additional details of workbench 10. The top portion of the bench comprises two planks 12 and 14 of any suitable wood, each measuring about 38 mm×180 mm ($1\frac{1}{2}\times7\frac{1}{4}$ in) wide by 120 cm (4 ft) long. Planks 12 and 14 are spaced about 15 mm ($\frac{5}{8}$ in) apart by wooden spacers 13 and 15 (FIG. 2A), and are held together by a transverse 5 mm ($\frac{1}{4}$ in) diameter and 375 mm ($14\frac{3}{4}$ in) bolt 20, passing through hole 23 im bench end 22 (FIGS. 1, 3, and 4).

Figures 3, 4:
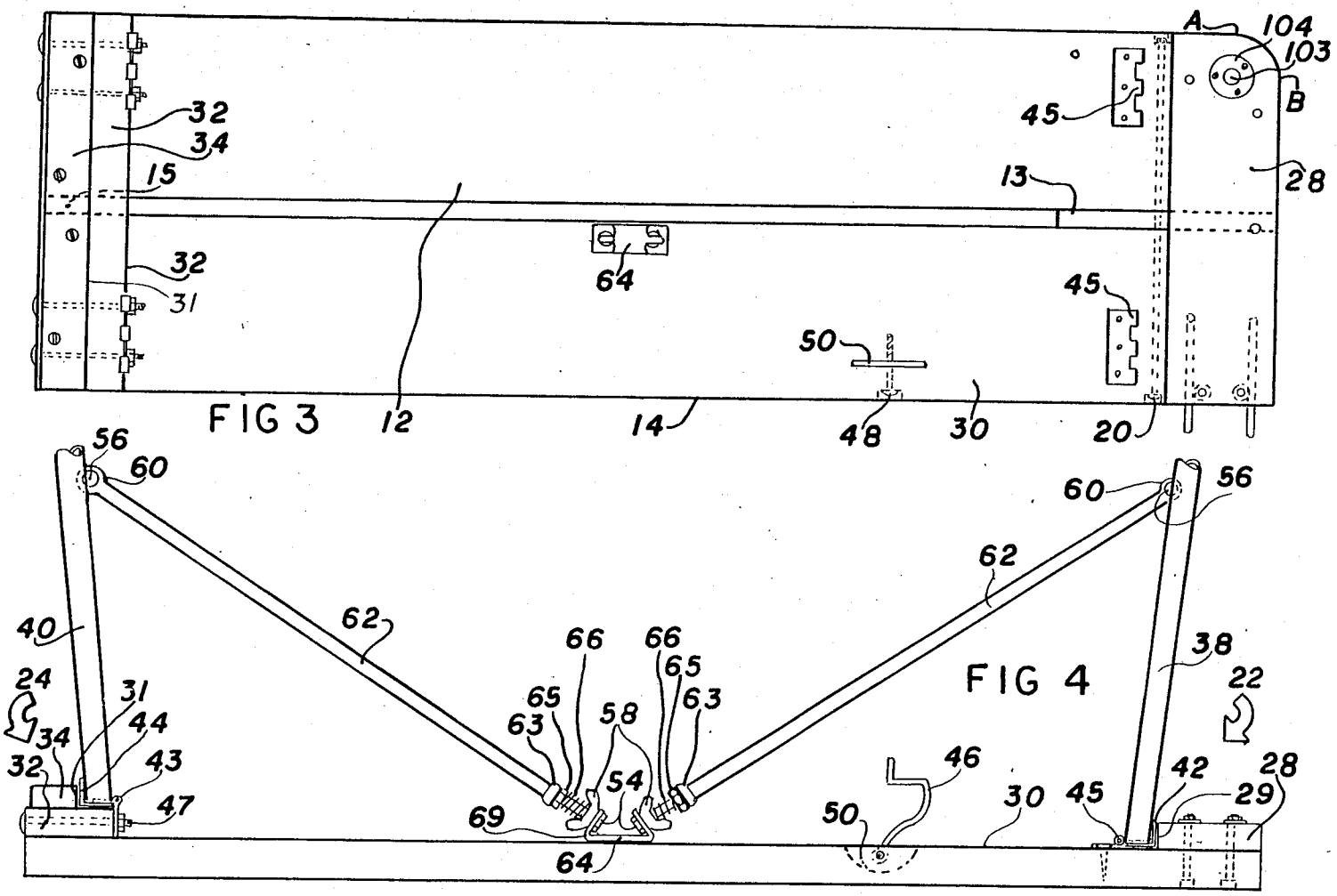
FIG. 3 is a plan view of the bottom side of the top of the bench.
FIG. 4 is a side view of the bench when upside-down.

Additional bracing is provided by a transverse end member 28 FIGS. 1, 3, and 4 of wood, 100 mm×32 mm ($4\times\frac{1}{2}$ in) wide and 38 mm (15 in) long, which is glued, screwed, and bolted across lower side 30 (FIGS. 1, 3, and 4) to planks 12 and 14 at end 22 of bench 10.

At the opposite end 24 a member 32 (FIGS. 3 and 4) of wood, 90 mm×32 mm ($3\frac{1}{2}\times1\frac{1}{4}$ in) and 180 mm (15 in) long is also screwed and glued across lower side 30. A third member 34 of wood 45 mm×25 mm ($1\frac{3}{4}\times1$ in) and 180 mm (15 in) long is screwed to member 32 at a distance of about 38 mm ($1\frac{1}{2}$ in) parallel to edge 36 of member 32.

All three members serve to strengthen an make the bench top very rigid. Also they provide strong and robust places on which to attach hinged pairs of fabricated bench legs.

LEGS

The function of the fabricated metal legs 38 and 40 (FIGS. 1 and and 2A) is to adequately support the bench top for heavy work, to support the bench against side to side movement and, by the addition of two stayrods 62, to brace the bench against endwise movement, yet still making it possible to quickly and easily unlock the stayrods and fold the legs inward for moving or storing.

One pair of metal legs 38 is fitted with two hinges 45 (FIGS. 3 and 4) One leaf of each hinge is welded to an inside face of an angle iron member 42 (FIG. 4) The other leaf of the hinge is screwed to lower side 30 of planks 12 and 14. When the legs are undolded ("out") as shown in FIG. 4 and are locked in position for supporting the bench, one outside face of angle iron member 42 will bear against side 29 of member 28, while the other outside face will bear against the lower side of the bench's top. Then when this pair of legs is folded "in" (FIG. 5) it will lie along and contact lower side 30 of the bench's top.

At the other end of the bench a similar pair of legs 40 are also fitted with a pair of hinges 43. One leaf of each hinge is spot welded to one flat inner face of angle iron member 44; the other leaf is attached by bolts 47 to member 32. Thus when the legs are adjusted in an open position (FIG. 4) and are locked in position for supporting the bench, one outside face of angle iron member 44 will bear against side 31 (FIGS. 3 and 4) of member 34, while the other side will bear against the face of member 32. Then when this pair of legs is folded "in" for moving and or storing (FIG. 6) the legs will lie along and contact the first pair of legs 38, with both pairs of legs being in parallel positions.

The positioning of the hinges in different heights or horizontal spacings or levels in respect to the bench top enables the pairs of legs, as well as the bench top, to fold together in a parallel and compact compact manner, as shown in FIG. 6. A spring clip 46 (FIGS. 4 and 6) is pivoted on a pin or screw 48 in slot 50 to clip or clamp over base member 52 to hold the legs and bench top together for moving and or storing.

Figure 7:
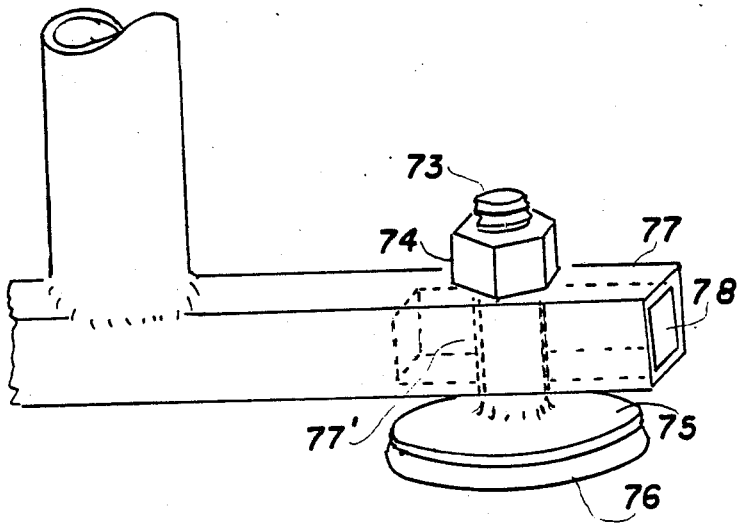
FIG. 7 is a perspective view of adjustable feet of the bench.

Metal legs 38 (FIGS. 1 and 2) of 25 mm (1 in) diameter steel tubing are welded in parallel form 315 mm 315 mm (12 7/16 in) apart to angle iron member 42 at the top end and to base member 52, which is made of 20 mm ($\frac{3}{4}$ in) square tubing, at ith lower end. Base member 52 has an eight-degree bend in its center as shown in FIGS. 1, 2A, 2B, 5 and 6 so as to lie over a stayrod or strut 62, when the legs are folded in. Base member projects 70 mm ($2\frac{3}{4}$ in) beyond the legs on each side of the bench. Ends 77 of the square tubing of base member 52 (FIG. 7) are each fitted with metal inserts 78 which may be welded or pressed in. In each end a hole 77' is drilled and tapped with a 10 mm ($\frac{1}{2}$ in) thread into which is screwed a threaded bolt 73 which is then locked with locknut 74 at its top. On the lower end of bolt 73 a metal plate 75 is welded and a rubber pad 76 is glued thereunder to provide a set of four non-marring, adjustable feet for the bench. Legs 38 and 40 (FIG. 4) are welded to angle iron members 42 and 44 respectively, so that the legs form an angle of about 95 degrees with the lower side 30 of the bench top. This slight spread-apart position of the legs when viewed from the bench's side not only adds additional stability to the bench but also facilitates the fitting-on and taking-off of the side platform

STAYRODS AND LOCKING MECHANISM

The stayrods or struts serve two purposes, firstly, to anchor anchor the legs at the 95 degree angle when the legs are unfolded, and to prevent endwise movement of the bench while work is being performed thereon. The locking mechanism secures the attachable end of the stayrod to a bracket under the workbench in a manner which it cannot loosen unintentionally due to work or vibration.

Figure 8:
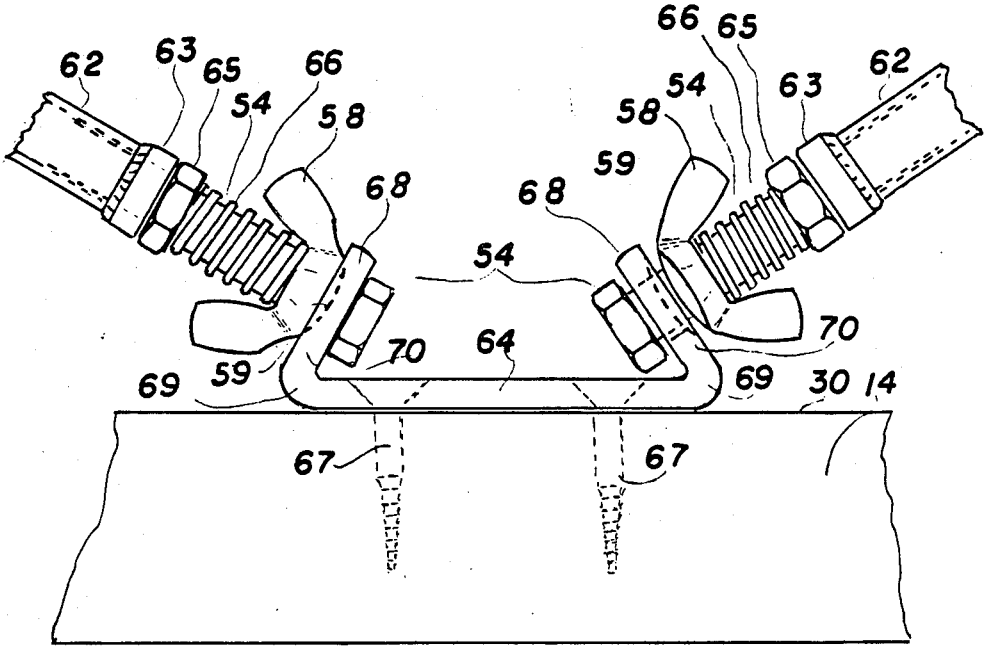
FIG. 8 is a side view of a stayrod locking assembly of the bench.
Figure 9:
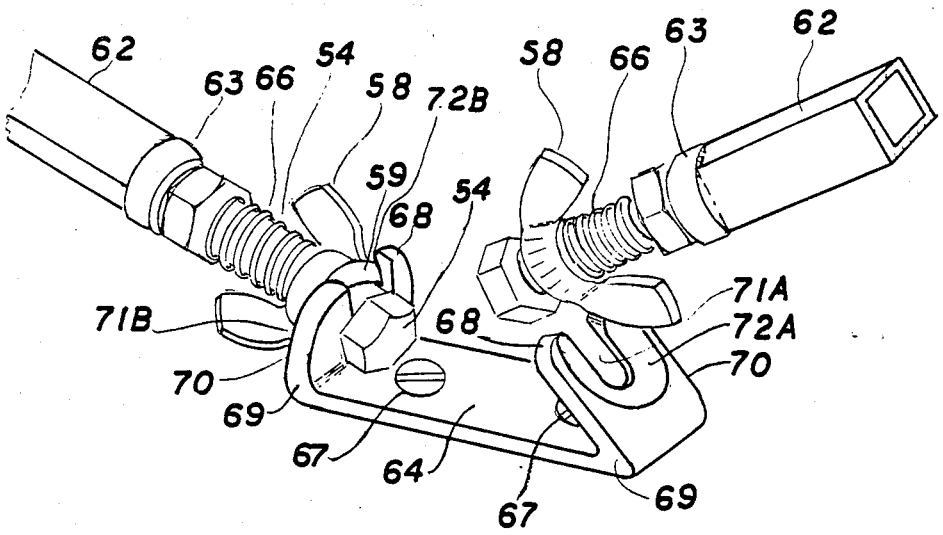
FIG. 9 is a perspective view of the stayrod locking assembly.

About 375 mm (14 in) from leg hinge 45 (FIG. 4), a center stayrod bar or strut 56 of 20 mm ($\frac{3}{4}$ in) diameter tubing is welded to each leg at its ands 57. A centrally mounted 50 mm (2 in) long sleeve 60 (FIGS. 1 and 2A) is welded to a 58 cm (23 in) long stayrod 62 of 12×12 mm ($\frac{1}{2}\times\frac{1}{2}$ in) square tubing at its lower end. Sleeve 60 is free to pivot on bar 56. Side to side movement can be controlled by weld spots 61. The other end of stayrod 62 (FIGS. 4, 8, and 9 has a threaded end piece 63 Each stayrod 62 is fitted with length-adjusting bolts 54 and locknut 65. These bolts are screwed into end piece 63 of each stayrod and are also fitted with a locking device comprising a wingnut 58 (FIG. 8) with a domed pressure face 59 and a pressure spring 66.

A bracket 64 (FIG. 3) is fitted lengthwise with screws 67 to lower side 30 of plank 14 in a central position between legs 38 and 40. Bracket 64 (FIG. 4) comprises a center section 64 (paralled to underside 30) and two end portions which are bent inward toward each other at an angle of about 60 degrees to center section 64, thus forming an apex at each bend. For about 15 mm ($\frac{5}{8}$ in) along the centers of protruding end portions 70 respective slots 71A and 71B (FIG. 9) are formed to receive bolts 54. The outer side of each slot 71A and 71B is machined to form circular concave recesses 72A and 72B, such that when bolts 54 are engaged in the slots, wingnut 58 can be screwed along the bolts. This allows domed pressure sufaces 59 of wingnuts 58 to mate with recesses 72A and 72B in a securely locked condition. Each bolt 54, which is attached to a stayrod 62, cannot be withdrawn from its slot (71A or 71B) until its wingnut 58 is loosened at least one full turn so as to disengage domed surface 59 adequately from its recesses. Two pressure springs 66 (FIG. 8) of 16-gage wire exert sufficient pressure against wingnuts 58 to prevent them from loosening unintentionally during work or by vibration caused by machinery used when work is performed on the bench. The spring also maintains pressure against wingnuts 58 after bolts 54 have been withdrawn from the slots, so that the wingnuts will not turn during moving and cause it to need resetting when the bench is being set up again for work.

FIXED STOP

A fixed stop 80 is fitted one side of plank 14, opposite to vernier vize 16 The stop canbe raised as needed, and the vise can be swivelled so that its movable jaw will face the fixed stop. Long pieces of lumber can be clamped against the stop and alongside the edge of the bench when the vise jaw is levered in its direction, thus clamping the workpiece in a most convenient and non-fatiguing position for its user.

Figure 10:
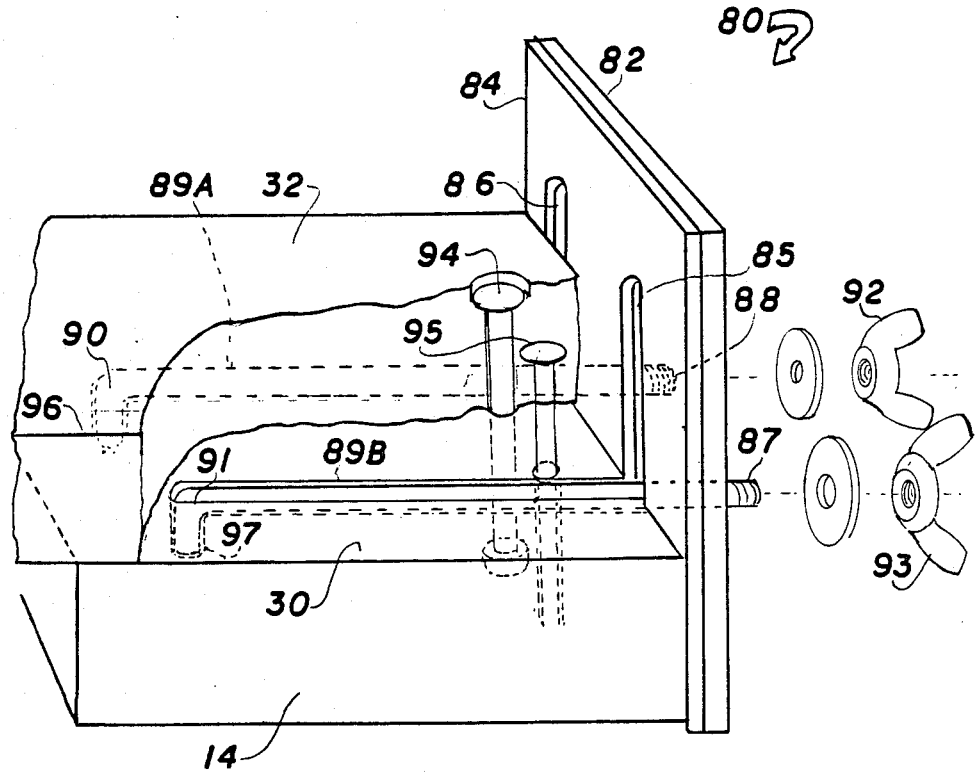
FIG. 10 is a perspective view of an adjustable fixed stop of the bench.

Fixed stop 80 (FIGS. 2A, 2B, and 10) formed of a steel plate 100×100 mm×25 mm (4×4×$\frac{1}{4}$ in) is provided at one end of plank 14. Metal plate 82 is faced with a sheet of rubber 84 about 5 mm ($\frac{1}{4}$ in) thick. Metal plate 82 and rubber sheet 84 have two slots 85 and 86, each about 50 mm (2 in) long and 10 mm ($\frac{3}{8}$ in) wide. These slots fit over protruding bolts 87 and 88 which extend inward between lower face 30 of plank 14 and member 32. Bolts 87 and 88 are prevented from either turning or pulling out by right angle bends 90 and 91 which are fitted into holes 96 and 97 in plank 14. Two bolts 94 and 95, (FIGS. 4 and 10) clamp member 28 against plank 14 to secure bolts87 and 88 in a tight position in cutaway channels 89A and 89B. Plate 82 (FIGS. 8, 2A and 2B), when fitted over prutruding bolts 87 and 88, is secured at any desired height by wingnuts 92 and 93.

SWIVEL PLATE AND SEMI-CIRCULAR GROOVE

Sometimes it is necessary to remove the vernier vise from the bench in order to have an all-over flat-topped surface. This is easily done by first removing the yoke nut on the vise's swivel pin and lifting the vise off. Since the vise swivels on a 5 mm (3/16 in) thick swivel plate, 101, it is desirous to lower this plate at least 3 mm ($\frac{1}{8}$ in) into the bench's top surface and additionally to cut a semi-circular groove 100 around its edge to provide an unrestricted pathway for the vise's locking plate when the vise is on and being rotated.

A semi-circular groove 100 (FIG. 2A) about 8 mm $\frac{3}{8}$ in) deep and 35 mm ($1\frac{1}{2}$ in) wide is cut in the bench top around the semi-circular edge of a quadrant-shaped swivel plate 101. Also 3 to 4 mm ($\frac{1}{8}$ in) of wood is removed from under swivel plate 101 so as to lower it down to almost the same level as the bench top. Swivel plate 101 is secured in position by two bolts which are countersunk into the top of the swivel plate which also pass through the bench top. A swivel pin hole 103 (FIG. 3) is drilled 45 mm ($1\frac{3}{4}$ in) from side A and end B of plank 12 and the corner of plank 12 is rounded as shown. A pressure plate 104 of 16-gage metal is secured by screwed to lower side 30 of plank 12 as shown.

Side platform 106 has many uses in conjunction with the folding workbench. It can be lowered to a height of 17 cm (7 in) and raised to a height of 78 cm. At its lowermost level it is used to reset long and or heavy pieces of lumber for sawing to shorter lengths, at higher levels it is used to support workpieces for hand sawing, and for still higher levels it is used for supporting tools, especially electric tools, such as saws, drills, sanders, routers. Also a suitable box can be made and attached to the platform to hold smaller tools, nails, screws, bolts etc.

It should be realised that worksurfaces, such as the bench top, is primarily for clamping workpieces and performing work thereon and is no place for leaving tools, especially electric ones, even for only a veryshort time, while, for instance, changes are being made in a clamping arrangement. Such tools can get knocked off and damaged. The side platform helds to eliminate these dangers by providing a resting place for such tools.

In addition, when joining two pieces of wood together with glue and or screws, the side platform can be positioned on the legs so as to support one of the workpieces so that its top portion is slightly above the level of the bench top, while the vernier vise in conjunction with the fixed stop can be used to hold the second workpiece down and in contact with the first piece, until such time that glue is set or screws are fitted. This clamping technique is advantageous when making right angle corner joints.

Figure 11:
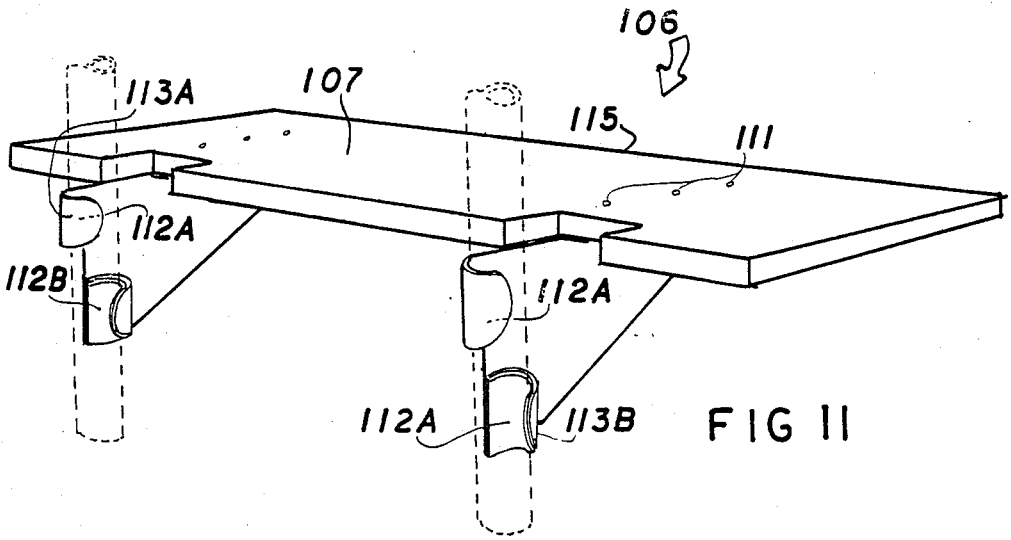
FIG. 11 is a perspective view of an adjustable side platform for use with the bench.
Figure 12:
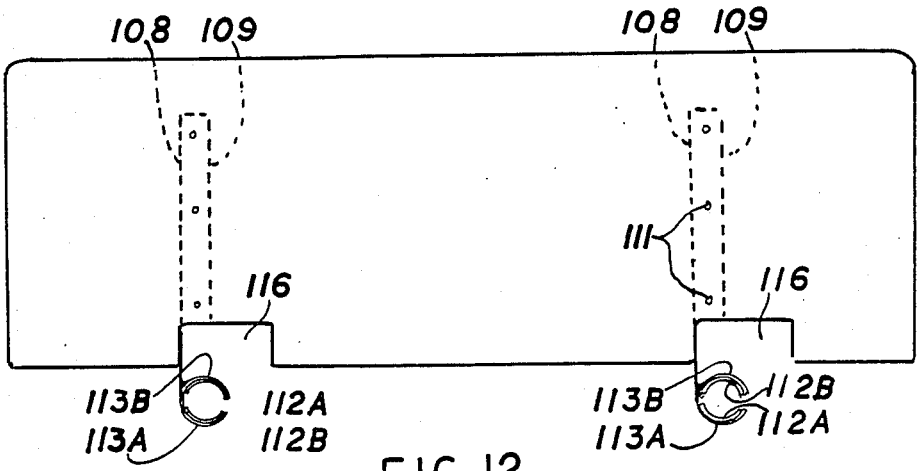
FIG. 12 is a plan view of the adjustable side platform.
Figure 13:
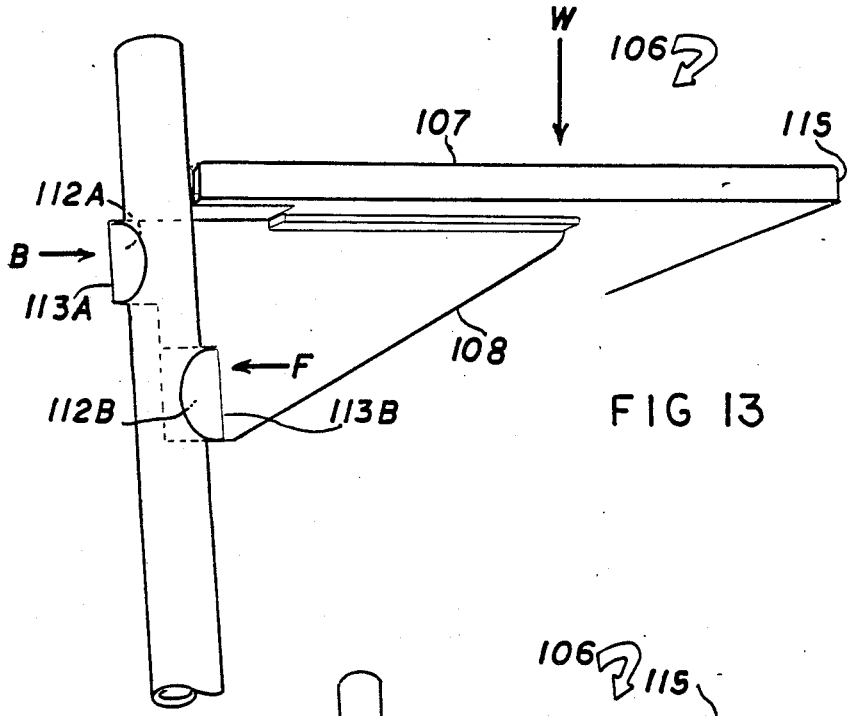
FIG. 13 is an end view of the adjustable side platform.

Side platform (FIG. 11) comprises a flat top 107 about 60 cm (24 in) long and 23 cm (9 in) wide of 12 mm (½ in) thick plywood. Two support brackets 108 (FIG. 12), each having a 12 mm (½ in) wide right angled flange 109, are attached to lower side 110 by screws or bolts 111. Each bracket 108 has two semi-circular rubber anchor pads 112A and 112B glued to similiar semi-circular hhok portions 113A and 113B of brackets 108. Rubber anchor pads 112A (FIG. 11 and 13) fit around the back of a pair of bench legs 117 (shown in phantom in FIG. 13), while at the same time two rubber anchor pads 112B fit against the front of these bench legs. Each pair of rubber pads of each bracket 108 are about 35 mm (1½ in) wide and are spaced about 25 mm (1 in) apart.

When weight is placed on the side platform in the direction of arrow W (FIG. 13), it causes rubber pads 112A to pull against the back of the bench legs in the direction of arrow B, while at the the same time causing rubber pads 112B to press against the front of these legs, in the direction of arrow F. The rubber pads grip the metal legs due to the pressure applied to them. The greater the weight on the platform, the greater the grip of the rubber pads.

Figure 14:
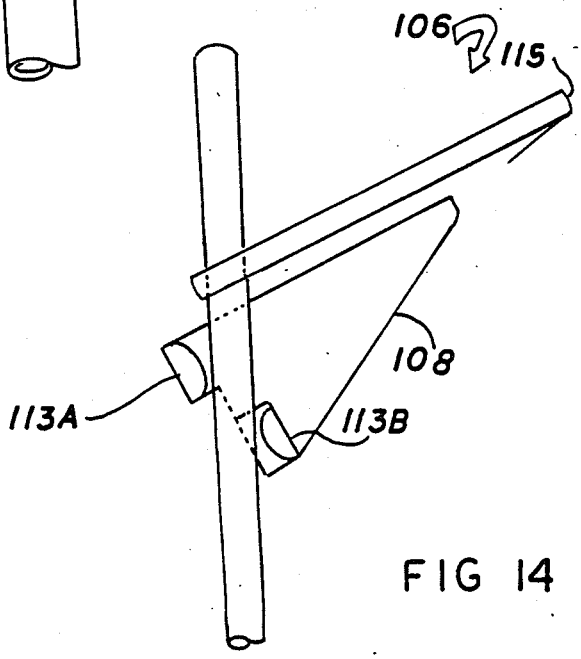
FIG. 14 is an end view of the side platform angled for removal.

In order to lower or raise the side platform on the bench legs, it is first necessary to relieve the pressure of the pads on the legs. This is done by tilting front 115 of top 107 upwards a few degrees, as shown in FIG. 14. In order to remove the platform completely from the legs, front 115 is tilted sufficiently upward for both hook portions on each bracket to be moved to the right (when viewed from the front) to become disengaged due to the angle that the spaced-apart pads make with the bench legs, shown clearly in FIG. 14. Top 107 has two cut away areas 116 each 65 mm (2½ in) wide and 33 mm (1¼ in) deep so as to allow sufficient side-to-side movement of the top to disengage or reengage it onto the legs.

The side platform can be cast from aluminium, or from one piece of pressure-injected plastic. The platform can be made without notches or made longer or wider and from any suitable material. It can be made with sides, as in a box, or with open mesh like a basket, for holding anything for use on or with the bench.

OPERATION

Figure 5:
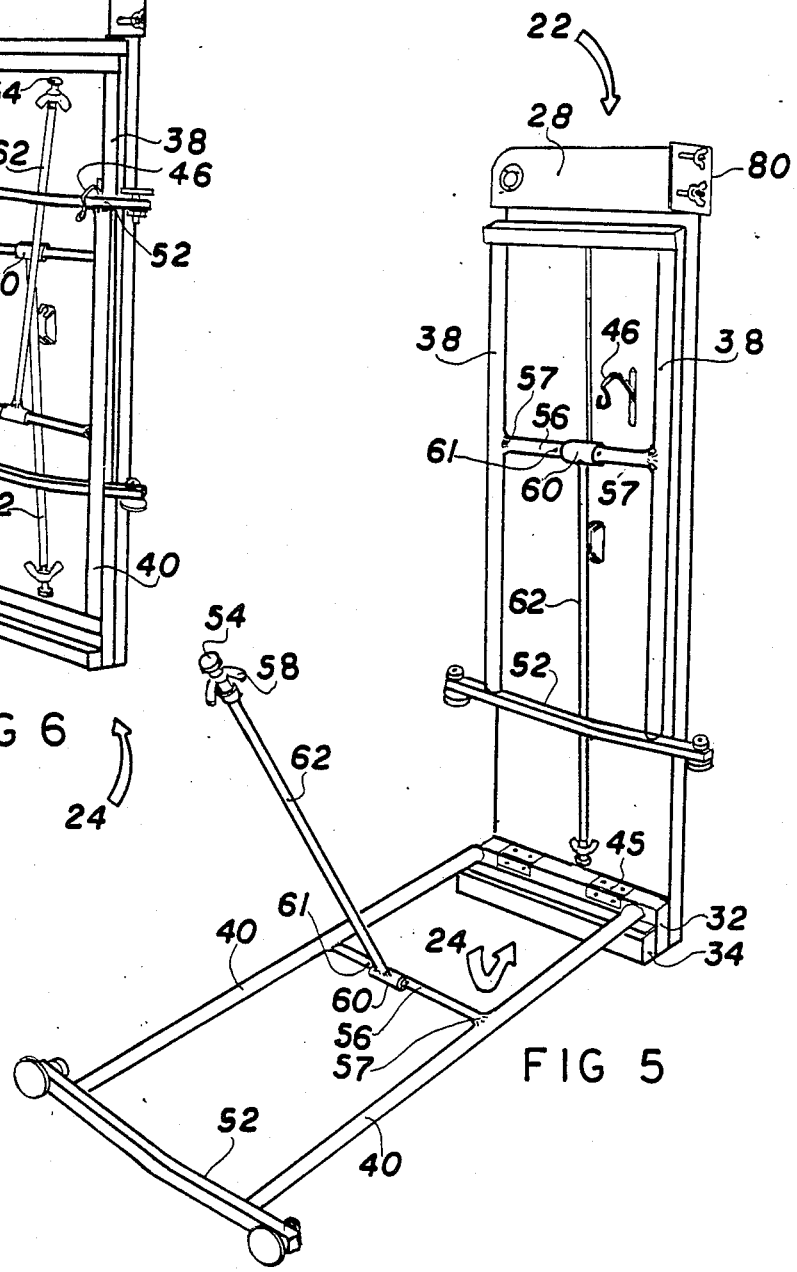
FIG. 5 is a perspective view of one pair of folded support legs for the bench.

To fold the bench the user would follow the following steps: First stand the bench on end 24 (swivel plate uppermost FIG. 5) or turn it upside-down (FIG. 4). Then loosen wingnut 54 on the lower end of bracket 64 and disengage end of stayrod 62 from the slot (FIGS. 8 and 9) and swing it well back (FIG. 5). Then loosen the other wingnut and disengage it from the top of bracket 64. Next fold in one set of legs 38 to occupy the position shown in FIG. 5. Then lower legs 40 until they are in contact with legs 38 (FIG. 6). Finally move spring clip 46 over base member 52Z. The bench can be placed in any narrow place or leaned against a wall. To open the bench, the foregoing proceedure is reversed.

When using fixed stop 84 (FIGS. 2A and 2B) it is raised only as high as necessary to clamp the workpiece. When not in use it can be lowered and locked below bench top level (FIG 2B). By making the bench top of two planks of the same cross sectional dimentions it can provide a new clamping arrangement by placing workholder 17 (FIG. 2B) on the opposite side of the bench to the vernier vise 16, which is used as a force applying tool and work holder 17 which can be angled, and thus can be arranged to face one another, as shown. Butcher block strips of wood (not shown) can now be laid diagonally across the bench and effectively clamped together. This method makes highly effective use of the width of the bench top.

SUMMARY, RAMIFICATIONS, AND SCOPE

Accordingly it is seen that, according to the invention, I have provided a folding workbench that can provide a far greater range of workpiece clamping positions, which will enable the user increased comfort over and above any other bench available on the market today when applying any of the woodworking techniques available. It can be made small enough so as to suit users who have less room for working than than available in garages and other workshops, or it can be made larger and or heavier for very large work. It is extremely useful for metal work, especially in the construction of small to medium sized machinery or fabrications. Its vise jaws are non-damaging to finely polished or intricate metal parts and can be swivelled to suitable positions for delicate work. The bench can be folded and put away in less than fifteen seconds, or brought out and erected in that short time. By the use of the patented workpiece holder shown in FIGS. 4–8 my aforementioned U.S. Pat. No. 4,475,727, the spaced apart workbench top planks provide an added dimentions to my vernier vise clamping force method. I.e., by providing two planks of equal width and spaced 15 mm (⅝ in) apart, the holder can be fitted to the second plank so that butcher block materials can be placed and clamped diagonally across the bench so as to mke additional use of the extra width thus obtained by the two planks.

The seven main advantages of the stayrod locking mechanism are: (1) Safety: once locked the stayrods stay locked. (2) The locking mechanism and stayrods provide positive rigidity. (3) The speed at which the stayrods can be connected, or disconnected provide a definite saving of time. (4) The stayrods can be made longer or shorter quickly and easily. (5) It is simple; anyone can easily understand and use it. (6) The locking mechanism and stayrods are compact and fit in with the folding leg fabrications. (7) Vibration does not affect the locking assembly, either during use or when in use.

The seven lesser advantages of the locking mechanism are: (a) There are no loose parts to become lost. (b) It is easy to manufacture. (c) It is easy to assemble, (d) It is ease to use; it can even be done blindfolded, (e) both rods and locking parts connect to the same bracket. (f) Fitting during manufacture is simple and fast, using only a screwdriver and one wrench.

The advantages of folding legs hinged at different levels under the bench are: (1) Legs fold in parallel to the bench top. (2) The unit is more compact. (3) The folded unit is weight supporting, i.e., when stacked for storage or shipping. (4) Because it is compact when folded, and weight supporting, it is far less likely to become damaged when stacked in trucks carrying home building materials.

The advantages of the side platform are: (1) Quick fitting of the side platform onto or off the bench legs can be accomplished as required. (2) It can be raised or lowered easily and speedily. (3) Can support pieces of lumber which are too heavy or akward to be lifted onto the bench for sawing. (4) It can be used to hold tools and machines used while working on the bench. (5) It can be used to support a band saw and adjusted so as to make the band saw table coincide with the level of the workbench, thereby utilizing the workbench top as an broad extension of the saw table of the band saw. It can be used for hand sawing pieces of lumber at or about knee height. (6) It can be used in conjunction with the vise fixed stop to clamp two or more pieces of wood at or about 90 degrees to each other for joining with glue and or screws and the like.

While the above description contains many specificities, these should not be construed as limitations on the scope of the invention, but as examplifications of the presently preferred embodiment thereof. For example, the bench top could be made larger or smaller, wider or narrower, or thicker or thinner, or of other materials such as plastic, fiberglass, wood or plastic laminates, aluminum or any other suitable material. The metal legs can be made of plywood, plastic, aluminum or any other suitable material. The side legs could be made of a single flat wide member, hingedly attached to the top of the bench. Thus the term "leg suppor" as used in claims refers to such a member, a single leg, or the two individual legs as described and shown, whether joined by struts or not. The side platform can be cast of aluminium or one piece pressure injected plastic. The unique locking and adjusting mechanism for securing the stayrods can be made of nylon. The workbench can be made without provision for the vernier vise and workholding attachments, and as such can be used for portable tables or for any other uses, such as for picnic, garden tables, camping, kindergartens, and the like. The bench can be made without a slot or with two or more slots for more varied clamping configurations.

Thus the scope of the invention should be determined by the appended claims and their legal equivalents, and not by the examples given.

I claim:

1. A table with quick-release struts for rapid assembly or disassembly, comprising:

a top comprising a rigid, flat member having a pair of major surfaces, one of which is an undersurface, and two opposite ends, a pair of elongated leg supports, each having an upper end for attachment to an undersurface of said top and a bottom end for placement on a floor, a pair of hinge means which hingedly attach said upper ends of said leg supports to said undersurface of said top, each hinge means attaching its respective leg support such that it can be unfolded to an open position normal to said top or to a closed position parallel to said top, and locking means for locking said leg supports in either their open position so that they will support said top in a horizontal position spaced from the floor or in their closed position to provide a compact arrangement, said means comprising:

a pair of elongated struts, one end of each being hingedly attached to a respective leg support at a position spaced from said upper end of each leg support, and bracket means for removably attaching said other end of each leg support to said undersurface of said top at a location intermediate said opposite ends thereof, said bracket means comprising a pair of separated strut-receiving arms which are attached to and which extend out from said undersurface, each arm containing a slot for receiving said other end of a respective strut, said other end of each strut having an end stop attached thereto for placement on one side of its respective strut-receiving arm and an adjustable clamp spaced along said arm inward from said end stop for selectively clamping said respective strut-receiving arm between said end stop and said adjustable clamp when said strut is inserted into said slot of said strut-receiving arm.

2. The table of claim 1 wherein each of said adjustable clamps comprises a wing nut threadedly attached to its strut and a spring and a base support for said spring for urging said wing nut toward said other end of said strut.

3. The table of claim 1 wherein each of said adjustable clamps comprises a member positioned on said strut and including means for adjusting the position of said member along said strut, said member having a domed surface facing said other end of its strut, each of said strut-receiving arms having a concave surface which can mate with said domed surface and which is bisected by said slot.

4. The table of claim 3 wherein each of said members positioned on said strut comprises a wing nut threadedly attached to its strut and a spring and a base support for said spring for urging said wing nut toward said other end of said strut, the side of each wing nut facing said other end of its strut having said domed surface.

* * * * *